US008744317B2

(12) United States Patent
Tsuji

(10) Patent No.: US 8,744,317 B2
(45) Date of Patent: Jun. 3, 2014

(54) ELECTRIFICATION APPARATUS AND IMAGE FORMING APPARATUS INCLUDING THE SAME

(75) Inventor: Hirofumi Tsuji, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 268 days.

(21) Appl. No.: 13/275,428

(22) Filed: Oct. 18, 2011

(65) Prior Publication Data

US 2012/0121295 A1 May 17, 2012

(30) Foreign Application Priority Data

Nov. 11, 2010 (JP) ..... 2010-252883

(51) Int. Cl.
*G03G 15/00* (2006.01)

(52) U.S. Cl.
USPC ..... 399/176; 399/115

(58) Field of Classification Search
USPC ..... 399/110, 115, 168, 174, 176
See application file for complete search history.

(56) References Cited

U.S. PATENT DOCUMENTS

| | | | | |
|---|---|---|---|---|
| 7,460,810 | B2 * | 12/2008 | Sampe et al. | 399/100 |
| 7,515,846 | B2 | 4/2009 | Miyaji | |
| 7,734,212 | B2 | 6/2010 | Miyaji et al. | |

FOREIGN PATENT DOCUMENTS

| | | | |
|---|---|---|---|
| JP | 6-3924 | A | 1/1994 |
| JP | 11-133767 | A | 5/1999 |
| JP | 2007-155844 | | 6/2007 |
| JP | 2007-193031 | A | 8/2007 |
| JP | 2007-241212 | | 9/2007 |

* cited by examiner

*Primary Examiner* — Hoan Tran
(74) *Attorney, Agent, or Firm* — Smith, Gambrell & Russell LLP

(57) ABSTRACT

An electrification apparatus includes: an electrification roller that rotates touching An image carrier to electrify a surface of the image carrier; a support member that by a bearing portion, supports rotatably a rotation shaft which is disposed at an end portion in a shaft direction of the electrification roller; and a cover member that is disposed on the rotation shaft and covers a portion of the rotation shaft which is near the bearing portion.

17 Claims, 8 Drawing Sheets

ELECTRIFICATION APPARATUS AND IMAGE FORMING APPARATUS INCLUDING THE SAME

This application is based on Japanese Patent Application No. 2010-252883 filed on Nov. 11, 2010, the contents of which are hereby incorporated by reference.

BACKGROUND OF THE INVENTION

1. Field of the Invention

The present invention relates to an electrification apparatus that is used for image forming apparatuses such as a copy machine, a printer, a facsimile, a multi-function machine of them and the like and an image forming apparatus that includes the electrification apparatus, more particularly, relates to an electrification apparatus that includes a support member which supports rotatably an electrification roller; and an image forming apparatus that includes the electrification apparatus.

2. Description of Related Art

Conventionally, in an image forming apparatuses that uses an electro-photographic system, an electrification apparatus is used to electrify a surface of a photoreceptor that is an image carrier. As the electrification apparatus, there known are: a corona electrification system which disposes a photoreceptor and a corona wire without contacting with each other and electrifies a surface of the photoreceptor by means of a corona discharge; and a contact electrification system which makes an electrification member such as an electrification roller and the like contact with the surface of the photoreceptor. However, in recent years, to reduce emission of ozone harmful to a human body, the contact electrification system, which has a less ozone emission amount, is used in many cases.

In such contact electrification system, in a case where the electrification roller is made to contact with the photoreceptor surface, in some cases foreign matter such a toner component, paper-sheet powder and the like adheres to the photoreceptor surface and moves to a surface of the electrification roller. If the foreign matter adheres to the electrification roller surface, the foreign matter causes defective electrification on the photoreceptor surface, which causes a serious influence on image quality of printed matter. To prevent such adhesion of the foreign matter to the electrification roller, conventionally, a cleaning member is pressurized to the electrification roller surface to sweep away the foreign matter that adheres to the electrification roller.

As a relating technology that removes the foreign matter on the electrification roller by means of the cleaning member, a technology is known, in which the cleaning member rotates with a linear velocity difference with respect to the electrification roller and reciprocates in a shaft direction of the electrification roller, thereby removing the foreign matter on the electrification roller.

However, in the above technology, a rotation shaft at an end portion of the electrification roller is held by a support member and there is a risk that the foreign matter such as the toner component, the paper-sheet powder and the like, which adheres to the photoreceptor surface, moves to the rotation shaft of the electrification roller.

SUMMARY OF THE INVENTION

It is an object of the present invention to provide: an electrification apparatus which does not have a risk that foreign matter invades between a rotation shaft of an electrification roller and a bearing portion of a support member of the electrification roller and keeps stable electrification performance; and an image forming apparatus that includes the electrification apparatus.

An electrification apparatus according to an aspect of the present invention includes: an electrification roller that rotates touching an image carrier to electrify a surface of the image carrier; a support member that by means of a bearing portion, supports rotatably a rotation shaft which is disposed at an end portion in a shaft direction of the electrification roller; and a cover member that is disposed on the rotation shaft and covers a portion of the rotation shaft which is near the bearing portion.

Still other objects of the present invention and specific advantages obtained by the present invention will be more apparent from description of embodiments performed hereinafter.

DESCRIPTION OF PREFERRED EMBODIMENTS

Hereinafter, an embodiment of the present invention is described with reference to the drawings; however, the present invention is not limited to the embodiment. Besides, applications of the present invention and terms and the like indicated here are not limited to the embodiment.

Figure 1:
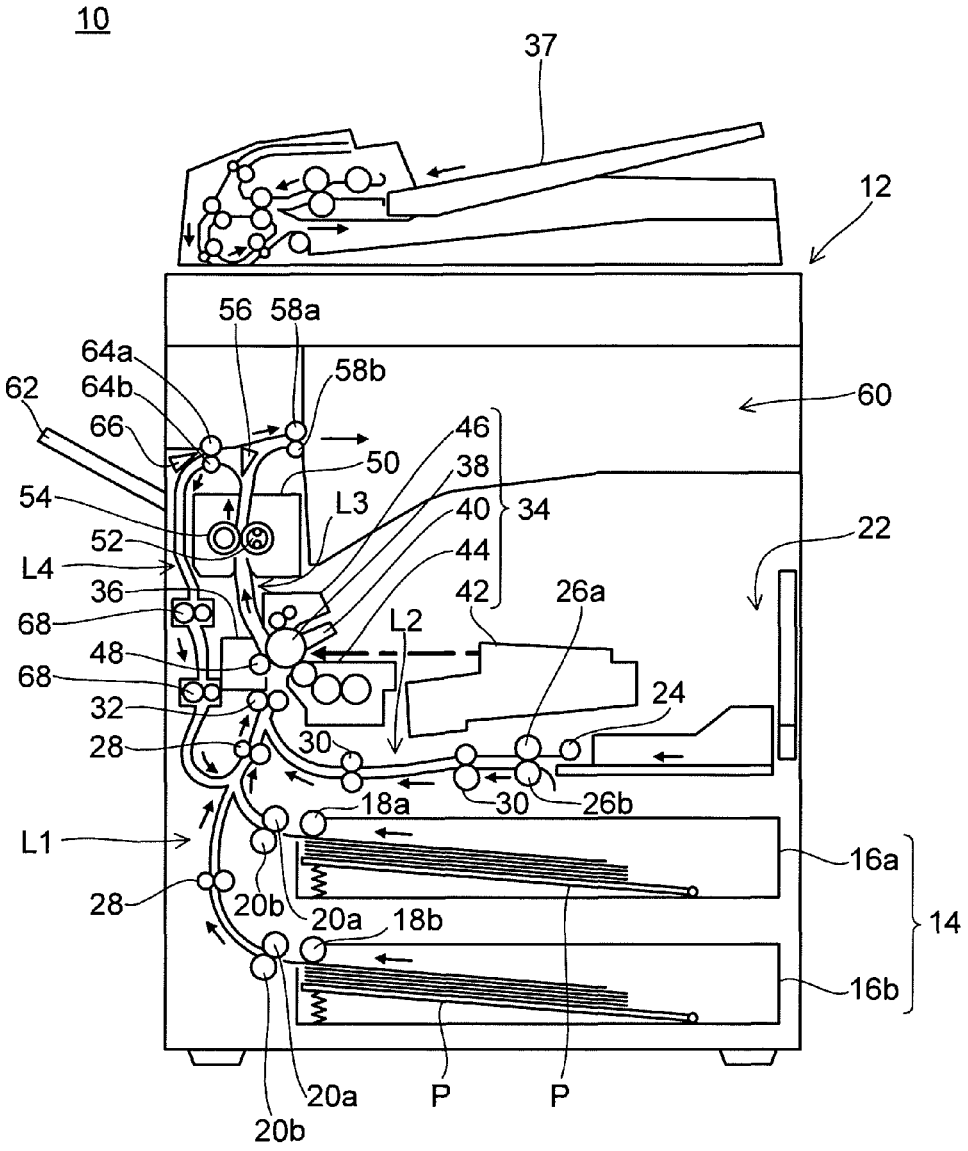
FIG. 1 is a view showing a schematic structure of an image forming apparatus that includes an electrification apparatus according to an embodiment of the present invention.

FIG. 1 is a view showing an in-housing paper-sheet ejection type of image forming apparatus. A cassette type of paper-sheet supply portion 14 is disposed in a lower portion of an image forming apparatus 10. The paper-sheet supply portion 14 has two-stage paper-sheet supply cassettes 16*a*, 16*b* in a vertical direction; and in the paper-sheet supply cassettes 16*a* and 16, paper sheets P before printing are stored. The paper sheets P stored in the paper-sheet supply cassettes 16*a*, 16*b* are fed out by a pick-up roller 18*a* (18*b*) one by one from selected one paper-sheet cassette 16*a* (16*b*); and the fed-out paper sheets P are sent out to a paper-sheet convey path L1 by a pair of paper-sheet supply rollers 20*a*, 20*b*.

A manual tray 22 is disposed in a right side of the image forming apparatus 10. If the manual tray 22 is opened to move from a closed state shown in FIG. 1 to a horizontal position state, it becomes possible to place, on the manual tray 22, the paper sheets P that have a size different from the paper-sheet supply portion 14. The paper sheets P placed on the manual tray 22 are fed out one by one by a pick-up roller 24; and the fed-out paper sheet P is sent out to a paper-sheet convey path L2 by a pair of paper-sheet supply rollers 26*a*, 26*b*.

The paper-sheet convey path L1 includes a plurality of pairs of convey rollers 28 and is disposed in a left portion to the paper-sheet supply portion 14. The paper sheet P sent out from the paper-sheet supply portion 14 is conveyed upward by each pair of convey rollers 28 of the paper-sheet convey path L1 and sent to an image transfer portion 36. Besides, the paper-sheet convey path L2 includes a plurality of pairs of convey rollers 30 and is disposed in a left portion to the manual tray 22. The paper sheet P sent out from the manual tray 22 is conveyed substantially horizontally by the pairs of convey rollers 30 of the paper-sheet convey path L2 and sent to the image transfer portion 36.

A pair of resist rollers 32 are disposed in an upstream in the paper-sheet convey direction with respect to the image transfer portion 36. The pair of resist rollers 32, in synchronization with timing of transferring a toner image onto the paper sheet P, sends out the paper sheet P to the image transfer portion 36.

A document supply and read apparatus 37 is disposed on an upper portion of the image forming apparatus 10. To take a copy of documents, the documents are placed on a document supply portion; the placed documents are separated one by one and sent out from the document supply portion to a document read portion, where image data of the documents are read.

An image forming portion 34 is disposed in a substantially central portion of the image forming apparatus 10. The image forming portion 34 includes a photoreceptor 38 that uses an organic photoreceptor (OPC photoreceptor) as a photosensitive material for forming a photosensitive layer; and around the photoreceptor 38, in order along the rotation direction of the photoreceptor 38, the image forming apparatus 34 includes: an electrification apparatus 40; a light exposure apparatus 42; a development apparatus 44; a transfer roller 48; and a cleaning apparatus 46.

If a surface of the photoreceptor 38 is electrified evenly at a predetermined polarity and a predetermined potential by the electrification apparatus 40, the light exposure apparatus 42, based on the image data of the document read by the document supply and read apparatus 37, forms on the photoreceptor 38 an electrostatic latent image of the document image.

The development apparatus 44 supplies electrified toner to the surface of the photoreceptor 38, thereby developing the electrostatic latent image to form a toner image. And, the toner image is transferred onto the paper sheet P by the transfer roller 48 of the image transfer portion 36. The paper sheet P on which the toner image is transferred is conveyed to a fixing portion 50 through a paper-sheet convey path L3. After the toner image is transferred onto the paper sheet P, toner remaining on the surface of the photoreceptor 38 is swept away and collected by the cleaning apparatus 46.

The fixing portion 50 includes: a fixing roller 52 that incorporates a heat source; and a pressure roller 54 that is in tight contact with the fixing roller 52. The paper sheet P, on which the toner image is transferred, is pressurized and heated by the fixing roller 52 and the pressure roller 54, whereby the toner image on the paper sheet P is melted and fixed. The paper sheet P, on which the toner image is fixed, is ejected into an in-housing paper-sheet ejection portion 60 by a pair of ejection rollers 58*a*, 58*b*.

The paper sheet P, on which the toner image is fixed, is switched in convey direction by a route switchover guide 56 if necessary; and ejected by convey rollers 64*a*, 64*b* onto a stack tray 62. Besides, in a case where both-side printing is performed, on the way of the ejection to the in-housing paper-sheet ejection portion 60, the ejection rollers 58*a*, 58*b* reversely rotate at timing a rear end of the paper sheet P passes by the switchover guide 56 and the route switchover guides 56, 66 are switched to a paper-sheet convey path L4. According to this, the paper sheet P passes between each pair of convey rollers 68 of the paper-sheet convey route L4 to be conveyed from the paper-sheet convey route L1 to the pair of resist rollers 32. Thereafter, a toner image is transferred onto a rear side as well of the paper sheet P at the image transfer portion 36; then, the paper sheet P is fixed again by the fixing portion 50 and ejected.

Figure 2:
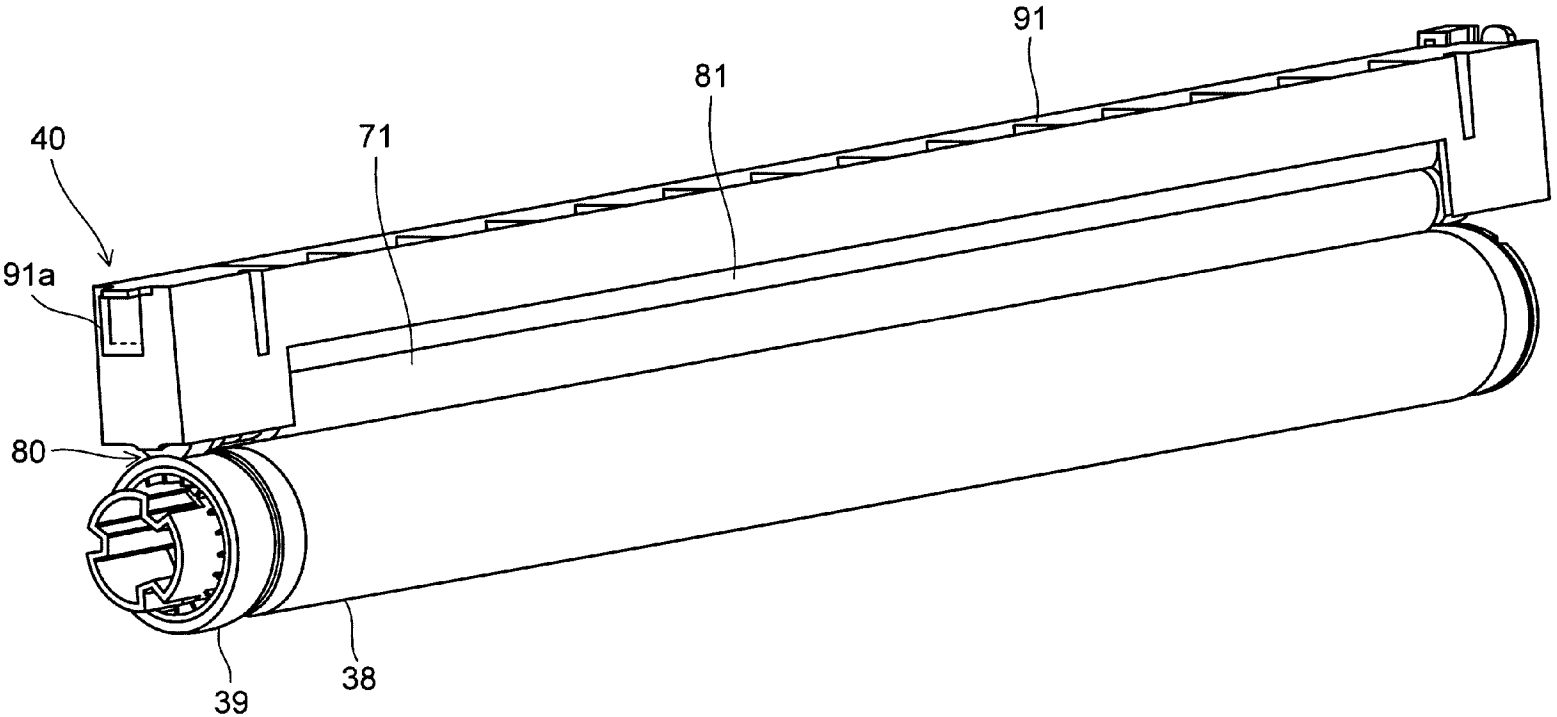
FIG. 2 is a perspective view showing an electrification apparatus according to an embodiment of the present invention.
Figure 3:
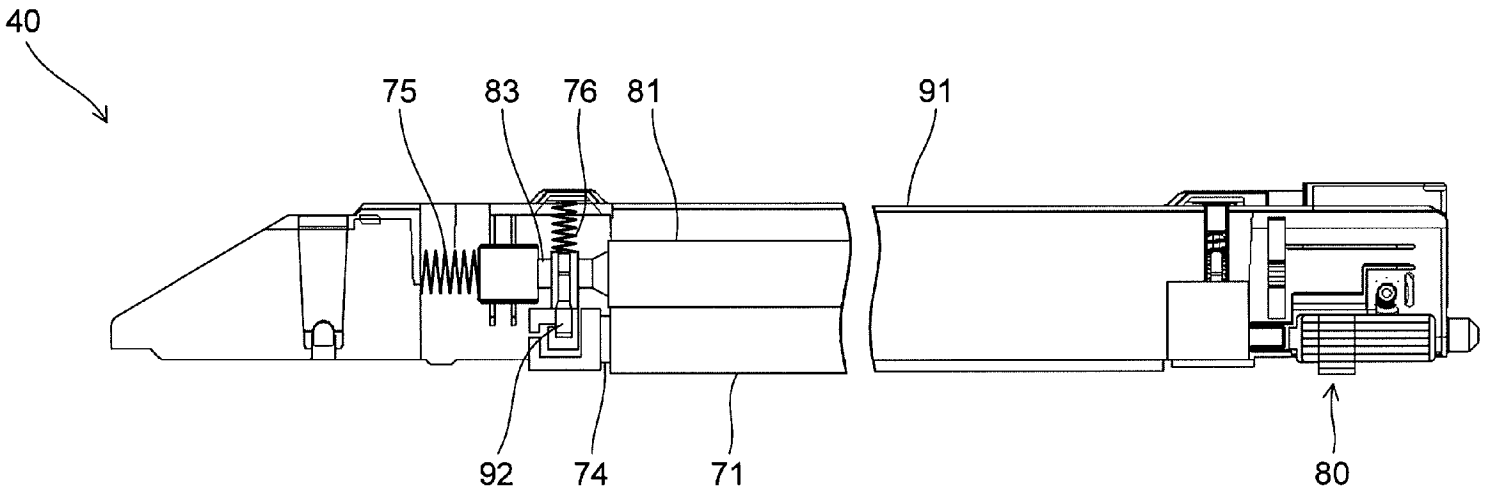
FIG. 3 is a partially sectional plan view of an electrification apparatus according to an embodiment of the present invention.
Figure 4:
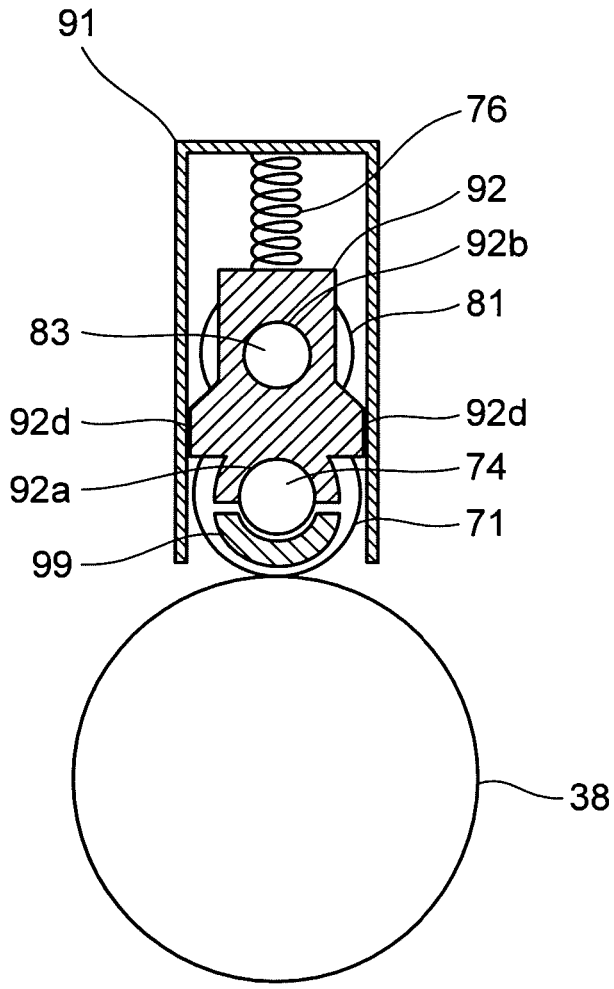
FIG. 4 is a side sectional view showing schematically a support member of an electrification apparatus according to an embodiment of the present invention.

Next, the electrification apparatus 40 used in the above image forming apparatus 10 is described by means of FIG. 2 to FIG. 4. FIG. 2 is a perspective view showing the electrification apparatus; FIG. 3 is a plan view showing the electrification apparatus with a left side sectioned; and FIG. 4 is a side sectional view showing schematically a support member. Here, FIG. 3 is a partially sectional view when seeing the electrification apparatus 40 from a read side of FIG. 2.

As shown in FIG. 2, the electrification apparatus 40 includes: an electrification roller 71; a cleaning member 81; a drive mechanism portion 80; and a case member 91 that houses the electrification roller 71, the cleaning member 81 and the drive mechanism portion 80.

The electrification roller 71 includes an electrically conductive rubber roller in which an elastic layer such as rubber and the like is formed on a circumferential surface of a metal core shaft; is pressurized by a predetermined nip pressure to be in tight contact with the photoreceptor 38; and driven to rotate as the photoreceptor 38 rotates.

The cleaning member 81 removes toner, paper-sheet powder and the like that adhere to the electrification roller 71; includes a sponge-like roller formed of rubber or a resin or a brush roller; extends in a shaft direction like the electrification roller 71; and touches a surface of an upper portion of the electrification roller 71. Besides, the cleaning member 81 is supported rotatably and supported movably in the shaft direction of the electrification roller 71.

The case member 91 is formed of a not-electrically conductive resin into a box shape that extends long in the shaft direction of the electrification roller 71; and an opening portion 91*a* is formed through a side surface of the case member 91. An end of a second spring member 76 described later faces the opening portion 91*a*, the end of the second spring member 76 is pressurized to be in tight contact with an electricity supply terminal that is connected to a power supply of the apparatus main body, so that it becomes possible to apply a predetermined voltage to the electrification roller 71.

The drive mechanism portion 80 is disposed on one end side in the case member 91 and connected to a drum-side gear 39 that is disposed on one end side of the photoreceptor 38. When the photoreceptor 38 rotates, thanks to rotation drive force of the drum-side gear 39, the drive mechanism portion 80 rotates and drives the cleaning member 81 with a linear velocity difference with respect to the electrification roller 71 and reciprocates the cleaning member 81 in the shaft direction. According to this, the foreign matter such as the toner, the paper-sheet powder and the like adhering to the electrification roller 71 is removed.

As shown in FIG. 3, the electrification apparatus 40, besides the above electrification roller 71, the cleaning member 81, the drive mechanism portion 80 and the case member 91, includes: a pair of support members 92 (the right support member 92 is invisible); a first spring member 75; and a pair of second spring members 76 (the right second spring member 76 is invisible); these members are housed in the case member 91.

The pair of support members 92 are disposed on both end sides in the shaft direction of the electrification roller 71; support rotatably a rotation shaft 74 disposed in the electrification roller 71; and support a shaft member 83 of the cleaning member 81 rotatably and movably in the shaft direction. The first spring member 75 is disposed to an outer side of one support member 92 (the left support member 92 in FIG. 3); and the drive mechanism portion 80 is disposed to an outer side of the other support member 92 (the right support member 92 in FIG. 3, invisible).

The first spring member 75 includes a coil spring; and butts an end portion of the shaft member 83 of the cleaning member 81 to pressurize the cleaning member 81 toward the drive mechanism portion 80.

As shown in FIG. 4, the pair of second spring members 76 include a coil spring; butt an upper portion of the support member 92 and butt an upper inner wall of the case member 91, thereby pressurizing the electrification roller 71 to the surface of the photoreceptor 38 via the support member 92. Besides, the support member 92 is provided with a bearing portion 92*a* that supports rotatably the rotation shaft 74 of the electrification roller 71; besides, is provided with a bearing hole 92*b* that supports rotatably the shaft member 83 of the cleaning member 81. The bearing portion 92*a* is formed into a semicircle with a lower side cut away; according to this, thanks to the pressurization force of the second spring member 76, the cleaning member 81 comes into tight contact with the electrification roller 71; and even if the support member 92 is pressurized by the second spring member 76, the bearing portion 92*a* bears the rotation shaft 74 of the electrification roller 71. Further, the support member 92 is provided with a butt surface 92*d* that butts the inner wall of the case member 91. Thanks to the butting of this butt surface 92*d* against the inner wall of the case member 91, the support member 92 does not move in a left-right direction of FIG. 4.

Accordingly, thanks to the pressurization force of the pair of second spring members 76, the electrification roller 71 is evenly pressurized to the surface of the photoreceptor 38; as the photoreceptor 38 rotates, the electrification roller 71 is driven to rotate and the cleaning member 81 touches the electrification roller 71. Here, a cover member 99 is disposed near the semicircular bearing portion 92*a*; details of this cover member 99 are described later.

Besides, the support member 92 is formed of a resin that has electrical conductivity; further, one end of one second spring members 76 is extended to the opening portion 91*a* (see FIG. 2) of the case member 91 and is in tight contact with the electricity supply terminal (not shown) that is connected to the power supply of the apparatus main body. According to this, it becomes possible to apply a predetermined voltage to the electrification roller 71 via the support member 92 and the rotation shaft 74. Here, instead of the one second spring members 76, electricity may be supplied to the electrification roller 71 via the first spring member 75 (see FIG. 3).

Figure 5:
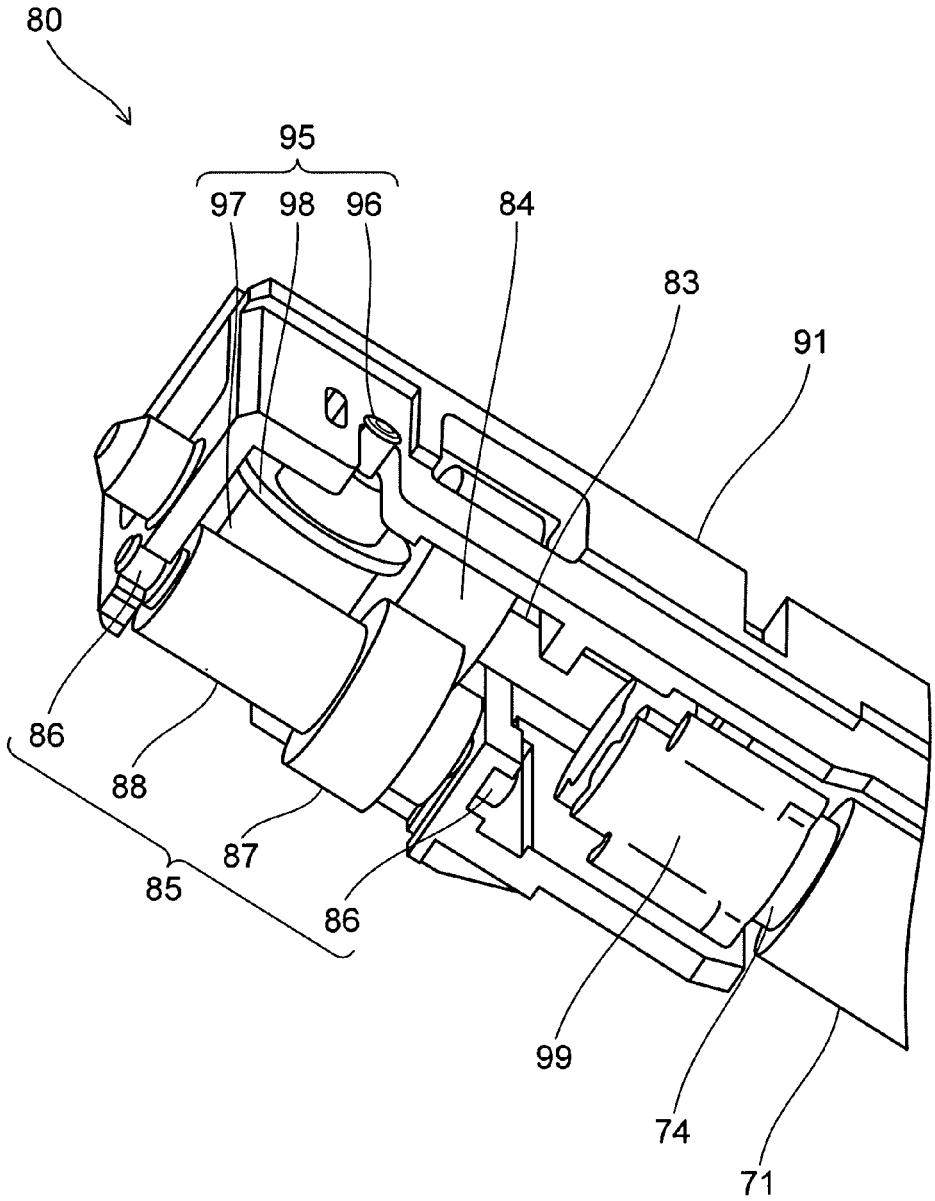
FIG. 5 is a perspective view showing a cover member and a periphery of the cover member according to an embodiment of the present invention.
Figure 6:
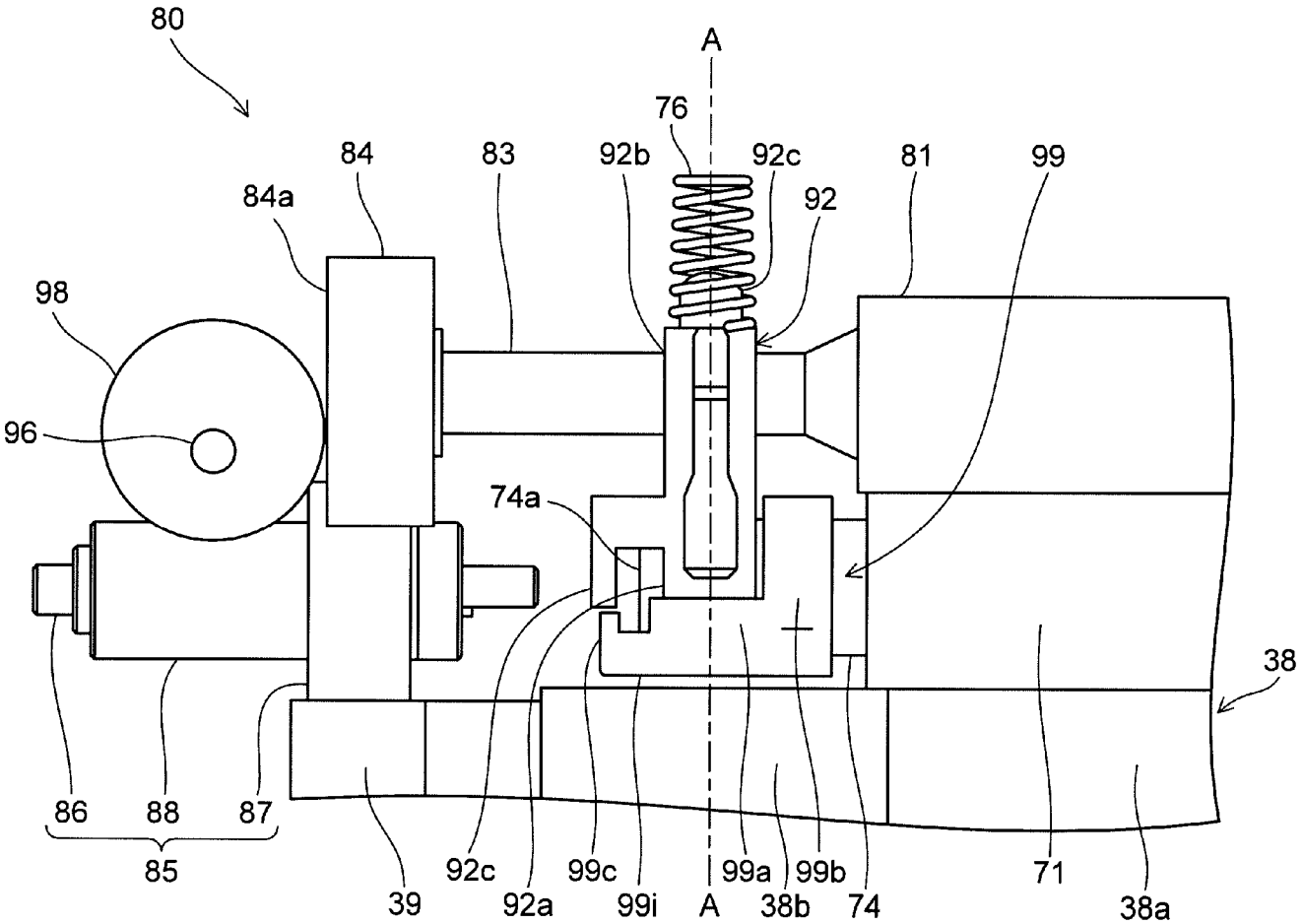
FIG. 6 is a plan view showing a cover member and a periphery of the cover member according to an embodiment of the present invention.

Next, a periphery of the cover member 99 is described by means of FIG. 5 and FIG. 6. FIG. 5 is a perspective view showing the cover member 99 and a periphery thereof; and FIG. 6 is a plan view showing the cover member 99 and the periphery thereof. Here, FIG. 5 is a perspective view seen from the photoreceptor side; and in FIG. 6, for convenience of the description, the case member 91 is omitted.

As shown in FIG. 5, the drive mechanism portion 80 is disposed near the cover member 99. The drive mechanism portion 80 includes: a drive shaft member 85 that extends in the same direction as the shaft direction of the electrification roller 71 and is disposed rotatably; and a cam member 95 that intersects with the drive shaft member 85 and is disposed rotatably.

The drive shaft member 85 has: a shaft portion 86 that is supported rotatably by the case member 91; an input-side gear 87 that is formed around the shaft portion 86; and a worm 88 that is disposed on the same core shaft of and adjacently to the input-side gear 87. The input-side gear 87 meshes with an output-side gear 84 that is disposed on the shaft member 83 (see FIG. 6 as well) of the cleaning member 81. The input-side gear 87 and the output-side gear 84 each include a spur gear or a helical gear.

The cam member 95 has: a shaft portion 96 that is supported rotatably by the case member 91; a worm wheel 97 that meshes with the worm 88 of the drive shaft member 85 and is formed about the shaft portion 96; and an eccentric cam 98 that is disposed on the same core shaft of and adjacently to the worm wheel 97.

As shown in FIG. 6, in the eccentric cam 98, the distance from the core shaft to an outer circumferential edge differs depending on circumferential positions. Specifically, the eccentric cam 98 is formed such that the distance from the rotation center to the outer circumferential edge becomes longer at a constant rate for every unit rotation angle and longest at an rotation angle of 180°; rotating beyond 180°, the distance from the rotation center to the outer circumferential edge reversely becomes shorter at a constant rate. The change of the distance from the rotation center to the outer circumferential edge for the rotation angle is set in accordance with a forward or backward movement amount of the reciprocation of the cleaning member 81.

Besides, the outer circumferential edge of the eccentric cam 98 is so disposed as to face a side surface portion 84*a* of the output-side gear 84; and output-side gear 84 is pressurized to the eccentric cam 98 by the first spring member 75 (see FIG. 3), so that the outer circumferential edge of the eccentric cam 98 always butts the side surface portion 84*a* of the output-side gear 84. Because of this, when the eccentric cam 98 rotates, the output-side gear 84 counters the pressurization force of the first spring member 75 (see FIG. 3) in accordance with the phase of the eccentric cam 98 to move in the shaft direction; and the cleaning member 81 moves in the shaft direction via the shaft member 83. When the eccentric cam 98 rotates halfway, the cleaning member 81 moves from one end side to the other end side in the shaft direction; and when the eccentric cam 98 rotates further halfway, the cleaning member 81 reversely moves from the other end side to the one end side, so that when the eccentric cam 98 makes one rotation, the cleaning member 81 makes one reciprocation.

As described above, the shaft member 83 disposed between the output-side gear 84 and the cleaning member 81 slides in the shaft direction through the bearing hole 92*b* formed through the support member 92 as the output-side gear 84 moves in the shaft direction. Besides, when the output-side gear 84 is rotated by the input-side gear 87, the shaft member 83 of the output-side gear 84 rotates in the bearing hole 92*b* of the support member 92. Here, the input-side gear 87 meshes with the output-side gear 84, and meshes with the drum-side gear 39 that is disposed on the photoreceptor 38 and includes a spur gear or a helical gear.

In the electrification apparatus 40 that includes such drive mechanism portion 80, when the photoreceptor 38 (see FIG. 2 as well) rotates, because the electrification roller 71 is pressurized by the pressurization fore of the pair of second spring members 76 to be evenly in tight contact with the surface of the photoreceptor 38, the electrification roller 71 is driven to rotate with supported by the bearing portion 92*a* of the support member 92. Besides, when the drum-side gear 39 rotates as the photoreceptor 38 rotates, the input-side gear 87 meshing with the drum-side gear 39 rotates. The rotation of the input-side gear 87 is transmitted to the output-side gear 84; thanks to this rotation, the cleaning member 81 rotates with supported by the bearing hole 92*b* of the support member 92. Besides, the rotation of the input-side gear 87 is transmitted to the worm 88; and the worm wheel 97 meshing with the worm 88 is slowed down and rotated, and the eccentric cam 98 also is unitarily slowed down and rotated. When the eccentric cam 98 rotates in this way, because the eccentric cam 98 is pressurized to the side-surface portion 84*a* of the output-side gear 84, the output-side gear 84 reciprocates in the shaft direction; further, the cleaning member 81 reciprocates in the shaft direction with supported by the bearing portion 92*b* of the support member 92.

Accordingly, the surface of the photoreceptor 38 is electrified by the electrification roller 71; and the foreign matter adhering to the electrification roller 71 is removed by the rotation and shaft-direction slide of the cleaning member 81 with respect to the electrification roller 71.

As described above, the support member 92 supports rotatably and slidably the shaft member 83 of the cleaning member 81 in the bearing hole 92*b*; besides, supports rotatably the rotation shaft 74 of the electrification roller 71 in the bearing portion 92*a*. Because the bearing portion 92*a* is formed into the semicircle (see FIG. 4 as well) with the lower side cut away, there is a risk that the foreign matter such as the toner component, the paper-sheet powder and the like, which adheres to the surface of the photoreceptor 38 disposed near the electrification roller 40, scatters; besides, toner scatters from the development apparatus 44 (see FIG. 1) and these foreign matters adhere to the rotation shaft 74 of the electrification roller 71. If the foreign matter invades between the rotation shaft 74 and the bearing portion 92*a*, it becomes impossible to obtain the smooth rotation of the electrification roller 71. To prevent this, the cover member 99 is disposed on the rotation shaft 74.

Figure 7:
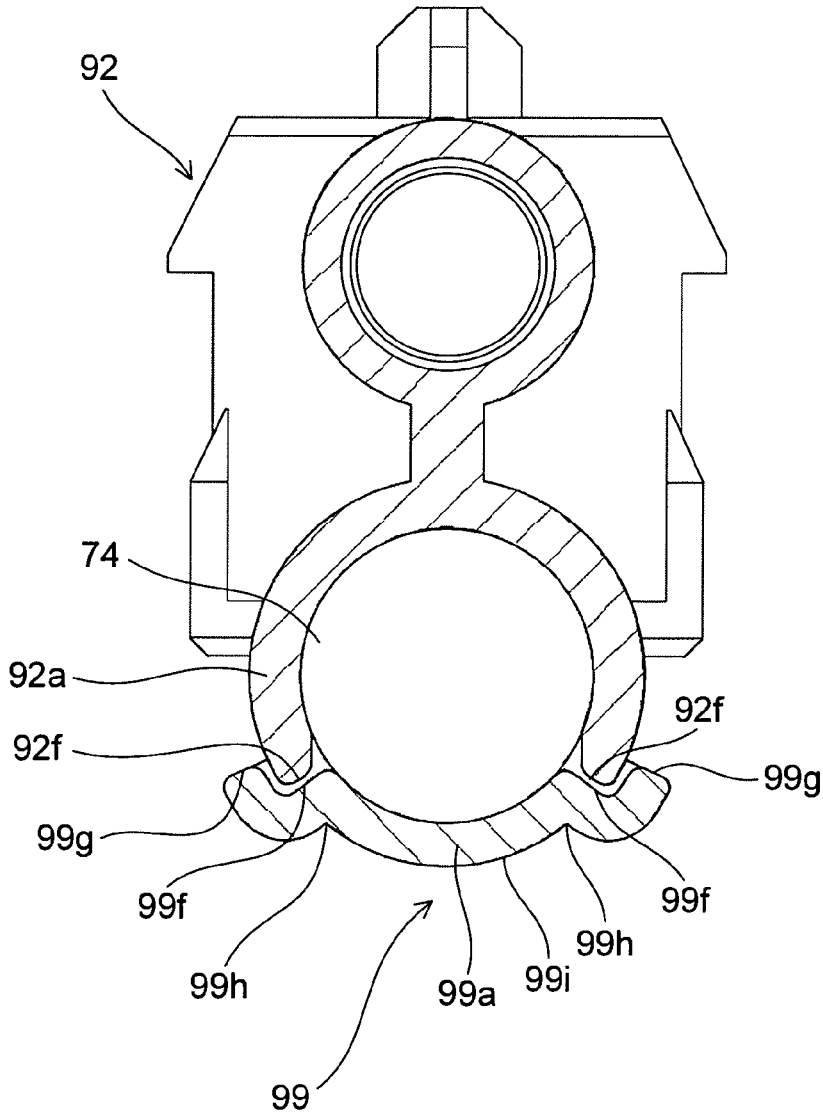
FIG. 7 is a sectional view showing a cover member and a support member according to an embodiment of the present invention.
Figure 8:
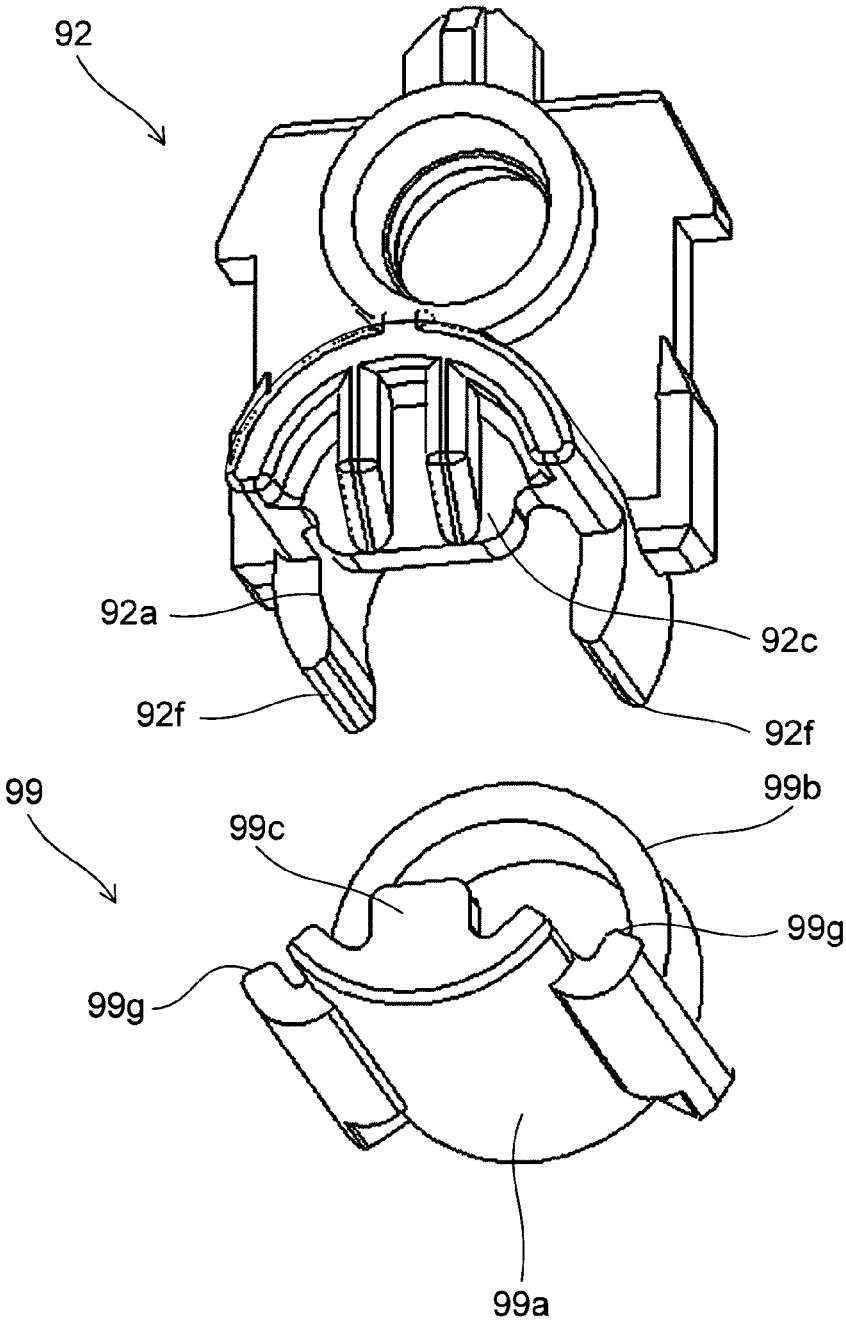
FIG. 8 is a perspective view showing a cover member and a support member according to an embodiment of the present invention.

The cover member 99 is described in detail by means of FIG. 7, FIG. 8 together with FIG. 6. FIG. 7 is a view showing the cover member 99 and the support member 92 that are sectioned along an A-A line indicated in FIG. 6; FIG. 8 is a perspective view showing separately the cover member 99 and the support member 92.

As shown in FIG. 6, the cover member 99 has: a circumferential-surface cover portion 99*a*; an end surface cover portion 99*c*; and a hold portion 99*b*, and is formed of a resin that has an insulation characteristic.

The hold portion 99*b* is disposed on a portion of the rotation shaft 74 that is close to the electrification roller 71; fitted on the entire circumference of the rotation shaft 74 to be held by the rotation shaft 74. The hold portion 99*b* is fitted on the rotation shaft 74, whereby the rotation shaft 74 has its outer circumferential surface covered by the hold portion 99*b*.

The circumferential-surface cover portion 99*a* has its one end held by the hold portion 99*b*; and is so formed as to extend toward a shaft end surface 74*a* of the rotation shaft 74. The shaft direction length of the circumferential-surface cover portion 99*a* is longer than the shaft direction length of the bearing portion 92*a* of the support member 92. Besides, the circumferential-surface cover portion 99*a*, as shown in FIG. 7, is close to and faces a surface of the rotation shaft 74 and is formed into a semicircle. Opposite portions 99*f* (see FIG. 7) are formed on both end portions of the semicircle of the circumferential-surface cover portion 99*a*; and the opposite portion 99*f* faces a bearing end surface 92*f* (see FIG. 7) of a semicircle of the bearing portion 92*a* with a slight gap. As described above, the circumferential-surface cover portion 99*a* is disposed oppositely to the bearing portion 92*a*, so that the foreign matter becomes unlikely to invade between the rotation shaft 74 and the bearing portion 92*a*.

As shown in FIG. 7, each opposite portion 99*f* of the circumferential-surface cover portion 99*a* is provided with an overlap portion 99*g*; the overlap portion 99*g* has an L shape in section, is so formed as to extend outward in a radial direction of the rotation shaft 74 and overlap with an outer edge of the bearing portion 92*a*. As described above, each overlap portion 99*g* closes the gap between the opposite portion 99*f* of the circumferential-surface cover portion 99*a* and the bearing end surface 92*f* of the bearing portion 92*a*, so that the foreign matter becomes more unlikely to invade between the rotation shaft 74 and the bearing portion 92*a*.

A concave portion 99*h* is formed at a portion where an outer surface 99*i* of each overlap portion 99*g* and an outer surface 99*i* of the circumferential-surface cover portion 99*a* meet each other. This concave portion 99*h* makes it possible to collect foreign matter that moves toward the rotation shaft 74. Especially, in a case where the electrification roller 71 is disposed under the photoreceptor 38, the concave portion 99*h* is useful to collect the foreign matter that falls from the photoreceptor 38 toward the rotation shaft 74.

As shown in FIG. 8, the bearing portion 92*a* is provided with an end-surface opposite portion 92*c* that extends from one end of the bearing portion 92*a* and is formed into a flat plate shape; and the end-surface opposite portion 92*c* is so disposed as to face the shaft end surface 74*a* (see FIG. 6) of the rotation shaft 74. The end-surface cover portion 99*c* of the cover member 99 is formed into a flat plate shape at one end in the shaft direction of the circumferential-surface cover portion 99*a*; and so disposed as to face the shaft end surface 74*a* (see FIG. 6) of the rotation shaft 74, besides, face the end-surface opposite portion 92*c* as well of the bearing portion 92*a*. As described above, the end-surface opposite portion 92*c* of the bearing portion 92*a* and the end-surface cover portion 99*c* of the cover member 99 cover the shaft end surface 74*a* of the rotation shaft 74, so that the foreign matter is prevented from invading between the rotation shaft 74 and the bearing portion 92*a*.

Back to FIG. 6, a structure is employed, in which when the cover member 99 is disposed on the rotation shaft 74 of the electrification roller 71, the outer surface 99*i* of the circumferential-surface cover portion 99*a*, which faces the photoreceptor 38, is smaller than an outer diameter of the surface of the electrification roller 71. According to this, even if the photoreceptor 38 is so disposed as to face the rotation shaft 71 and the cover member 99 is disposed on the rotation shaft 74, the cover member 99 does not collide with the photoreceptor 38 and the electrification apparatus 40 does not have difficulty in electrifying the surface of the photoreceptor 38.

Besides, the photoreceptor 38 is formed of a pipe made of a metal such as iron, aluminum and the like that has electrical conductivity; a photosensitive layer 38*a* formed of an organic material is applied to the surface of the metal pipe which the electrification roller 71 faces; and a non-application region 38*b*, on which the photosensitive layer 38*a* is not applied, is formed on a surface of an end portion of the metal pipe.

The rotation shaft 74 of the electrification roller 71 faces the non-application region 38*b* of the photoreceptor 38. The cover member 99 is disposed on the rotation shaft 74 and the rotation shaft 74 faces the non-application region 38*b* of the photoreceptor 38 via the cover member 99 that has the insulation characteristic. According to this, to electrify the photosensitive layer 38*a* of the photoreceptor 38, a voltage is applied to the electrification roller 71; however, even if this voltage is applied, the rotation shaft 74 of the electrification roller 71 and the non-application region 38*b* of the photoreceptor 38 are electrically insulated by the cover member 99, so that it is possible to prevent a defective image due to a voltage leak from the rotation shaft 74 to the photoreceptor 38.

According to the above embodiment, the electrification apparatus 40 includes: the electrification roller 71 that rotates touching the photoreceptor 38 to electrify the surface of the photoreceptor 38; the support member 92 that by means of the bearing portion 92*a*, supports rotatably the rotation shaft 74 disposed at the end portion in the shaft direction of the electrification roller 71; and the cover member 99 that is disposed on the rotation shaft 74 and covers the portion of the rotation shaft 74 that is near the bearing portion 92*a*.

According to this structure, even if the foreign matter such as the toner component, the paper-sheet powder and the like, which adheres to the surface of the photoreceptor 38, moves to the rotation shaft 74 of the electrification roller 71, the foreign matter is prevented by the cover member 99 from invading between the rotation shaft 74 and the bearing portion 92*a*. Accordingly, there is not a risk that an uneven slide occurs between the rotation shaft 74 and the bearing portion 92*a*; and the electrification roller 71 rotates stably, so that it is possible to keep the electrification performance.

Here, in the above embodiment, the structure is described, in which the bearing portion 92*a* is formed into the semicircle with the lower side cut away; however, the present invention is not limited to this: the bearing portion may be formed into a round hole in which the rotation shaft 74 fitted; and the cover member 99 may cover the rotation shaft 74 on both sides in the shaft direction of the bearing portion and the shaft end surface 74*a* of the rotation shaft 74. Also in this case, the same effects as in the above embodiment are obtained.

The present invention is applicable to an electrification apparatus that is used for image forming apparatuses such as a copy machine, a printer, a facsimile, a multi-function machine of them and the like and an image forming apparatus that includes the electrification apparatus, more particularly, applicable to an electrification apparatus that includes a support member which supports rotatably an electrification roller; and an image forming apparatus that includes the electrification apparatus.

What is claimed is:

1. An electrification apparatus comprising:

an electrification roller that rotates touching an image carrier to electrify a surface of the image carrier;

a support member that, by means of a bearing portion, supports rotatably a rotation shaft which is disposed at an end portion in a shaft direction of the electrification roller; and a cover member that is disposed on the rotation shaft and covers a portion of the rotation shaft which is near the bearing portion, wherein the bearing portion is formed into a semicircle with which the rotation shaft engages rotatably; and the cover member includes:

a hold portion that is disposed on the rotation shaft; and a circumferential-surface cover portion that extends from the hold portion, faces an outer circumferential surface of the rotation shaft, and faces the bearing portion.

2. The electrification apparatus according to claim 1, wherein the circumferential-surface cover portion is so formed as to cover a gap that is formed at a portion which faces the bearing portion.

3. The electrification apparatus according to claim 2, wherein the cover member includes an overlap portion that extends outward in a radial direction of the circumferential-surface cover portion, overlaps with an outer edge of the bearing portion and has an L shape in section.

4. The electrification apparatus according to claim 3, wherein a concave portion is formed at a portion where an outer surface of the overlap portion and an outer surface of the circumferential-surface cover portion meet each other.

5. The electrification apparatus according to claim 1, wherein the support member includes an end surface opposite portion that extends from the bearing portion and faces an end surface of the rotation shaft; and the cover member extends from the circumferential-surface cover portion, faces the end surface of the rotation shaft, and faces the end surface opposite portion.

6. The electrification apparatus according to claim 1, wherein the hold portion is disposed on a portion of the rotation shaft that is close to the electrification roller and fitted on an entire circumference of the rotation shaft.

7. The electrification apparatus according to claim 1, wherein the circumferential-surface cover portion is close to and faces an outer circumferential surface of the rotation shaft and is formed into a semicircle.

8. An image forming apparatus comprising the electrification apparatus according to claim 1.

9. An electrification apparatus comprising:

an electrification roller that rotates touching an image carrier to electrify a surface of the image carrier;

a support member that, by means of a bearing portion, supports rotatably a rotation shaft which is disposed at an end portion in a shaft direction of the electrification roller; and a cover member that is disposed on the rotation shaft and covers a portion of the rotation shaft which is near the bearing portion, wherein the rotation shaft faces a surface of an end portion of the image carrier on which a photosensitive layer is not applied; and the cover member is formed of an insulation material.

10. The electrification apparatus according to claim 9, wherein the cover member includes:

a hold portion that is disposed on the rotation shaft; and a circumferential-surface cover portion that extends from the hold portion, faces an outer circumferential surface of the rotation shaft, and faces the bearing portion; and the outer surface of the circumferential-surface cover portion faces the surface of the end portion of the image carrier on which the photosensitive layer is not applied.

11. An electrification apparatus comprising:

an electrification roller that rotates touching an image carrier to electrify a surface of the image carrier;

a support member that, by means of a bearing portion, supports rotatablv a rotation shaft which is disposed at an end portion in a shaft direction of the electrification roller; and a cover member that is disposed on the rotation shaft and covers a portion of the rotation shaft which is near the bearing portion, and a cleaning member that touches a surface of the electrification roller, rotates and reciprocates in a shaft direction, wherein the support member supports a shaft member that is formed at an end portion in a shaft direction of the cleaning member rotatably and slidably in the shaft direction;

the bearing portion is formed into a semicircle with which the rotation shaft engages rotatably; and the cover member includes:

a hold portion that is disposed on the rotation shaft; and a circumferential-surface cover portion that extends from the hold portion, faces an outer circumferential surface of the rotation shaft, and faces the bearing portion.

12. The electrification apparatus according to claim 11, wherein the circumferential-surface cover portion is so formed as to cover a gap that is formed at a portion which faces the bearing portion.

13. The electrification apparatus according to claim 12, wherein the cover member includes an overlap portion that extends outward in a radial direction of the circumferential-surface cover portion, overlaps with an outer edge of the bearing portion and has an L shape in section.

14. The electrification apparatus according to claim 13, wherein a concave portion is formed at a portion where an outer surface of the overlap portion and an outer surface of the circumferential-surface cover portion meet each other.

15. The electrification apparatus according to claim 11, wherein the support member includes an end surface opposite portion that extends from the bearing portion and faces an end surface of the rotation shaft; and the cover member extends from the circumferential-surface cover portion, faces the end surface of the rotation shaft, and faces the end surface opposite portion.

16. The electrification apparatus according to claim 11, wherein the hold portion is disposed on a portion of the rotation shaft that is close to the electrification roller and fitted on an entire circumference of the rotation shaft.

17. The electrification apparatus according to claim 11, wherein the circumferential-surface cover portion is close to and faces an outer circumferential surface of the rotation shaft and is formed into a semicircle.

* * * * *